United States Patent [19]

Saicheck, Jr. et al.

[11] Patent Number: 4,688,618

[45] Date of Patent: Aug. 25, 1987

[54] CARRIER ASSEMBLY FOR VERTICAL BLINDS

[76] Inventors: Harvey E. Saicheck, Jr., 7601 N. 50th Dr., Glendale, Ariz. 85301; Harvey E. Saicheck, Sr., 6631 Salt Lake Ave., Sp. #2, Bell, Calif. 90201

[21] Appl. No.: 827,463

[22] Filed: Feb. 10, 1986

[51] Int. Cl.[4] ..... F06B 9/30

[52] U.S. Cl. ..... 160/168 R

[58] Field of Search ..... 160/168 R, 172, 176 R, 160/178 R, 166 R, DIG. 17

[56] References Cited

U.S. PATENT DOCUMENTS

| | | | |
|---|---|---|---|
| 4,122,884 | 10/1978 | Salzmann | 160/168 R |
| 4,262,728 | 4/1981 | Debs | 160/172 X |
| 4,293,021 | 10/1981 | Arena | 160/178 R |
| 4,316,493 | 2/1982 | Arena | 160/168 R |
| 4,335,775 | 6/1982 | Frentzel et al. | 160/168 R X |
| 4,381,811 | 5/1983 | Frentzel et al. | 160/168 R |

*Primary Examiner*—Robert W. Gibson, Jr.
*Attorney, Agent, or Firm*—Gregory J. Nelson

[57] ABSTRACT

A carrier assembly for window coverings such as vertical blinds or shutters or louvers is disclosed. The carrier assembly includes a generally horizontally disposed track within which a plurality of slidable vane carriers are disposed. Each of the vane carriers has a vane support which is actuated for rotation of the vanes by means of a control rod extending axially within the track. The individual vane support carriers are interconnected by links which are received in slots or apertures in the carriers and positioned to minimize any torque or twisting of the carriers as they move within the track. The carriers are slidably actuated by a cord loop extending through the carriers and fixed at a lead carrier which moves in response to actuation of the cord and through the link arrangement which closes the blinds positioning the carriers at predetermined spaced locations along the track. A plurality of rod support spacers are provided at the side of the master carrier opposite the vane support carriers. The rod support carriers are magnetically attracted to one another and move as a group and are deposited at predetermined locations by engagement with a trip pin to support the actuator rod in a blind open or partially open position. In addition, the present invention contemplates a box-like connector which can be placed about a splice of adjacent track sections and which is secured to the track sections by mechanical fasteners to minimize misalignment.

6 Claims, 15 Drawing Figures

28
30
20B
20A
20
120
122

94
93
92
91
120
20A 20C
92
110D
110E
20B
110B
B
110C
2
20A
110
24
2
110A
120
91
92
93
94
95
96
97
98
20
B 114
110
20A
120
20

115
20A
112
110
114
20
120
91

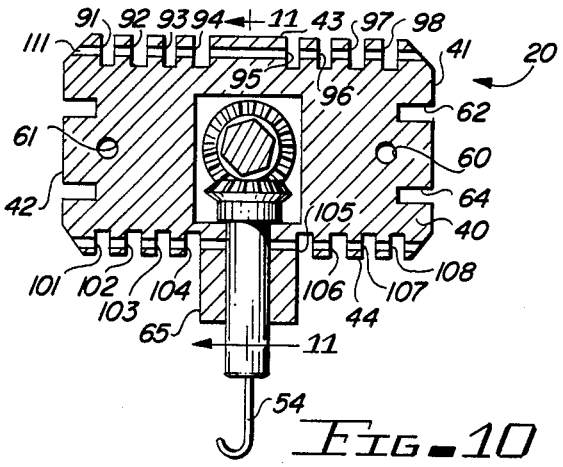
FIG. 10
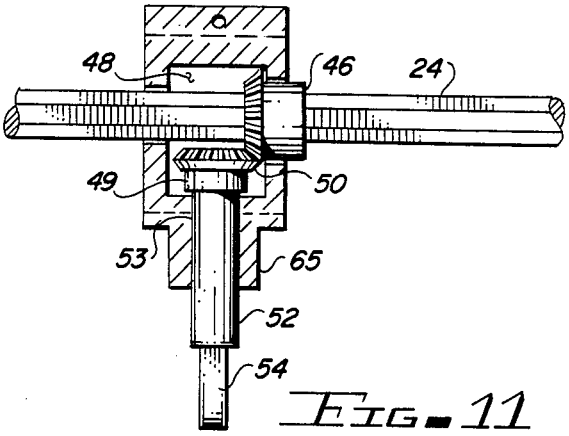
FIG. 11
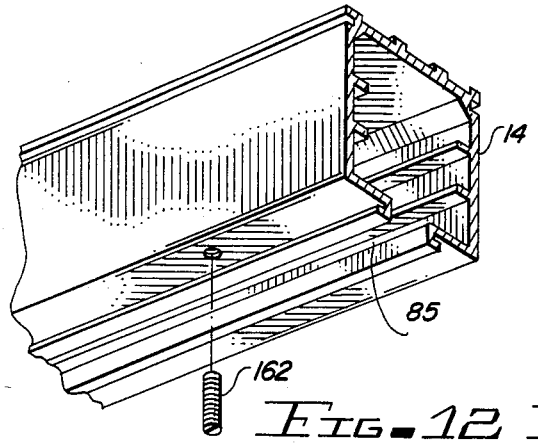
FIG. 12
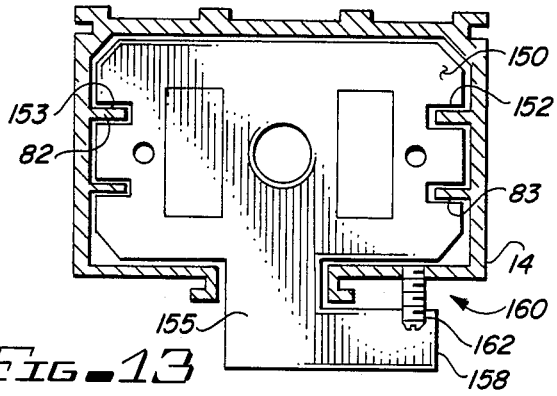
FIG. 13
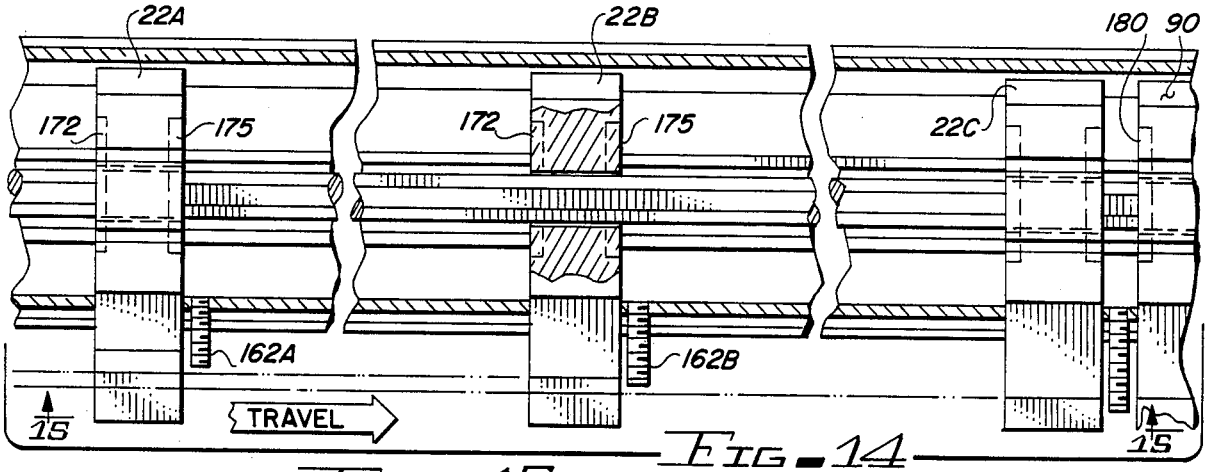
FIG. 14
FIG. 15
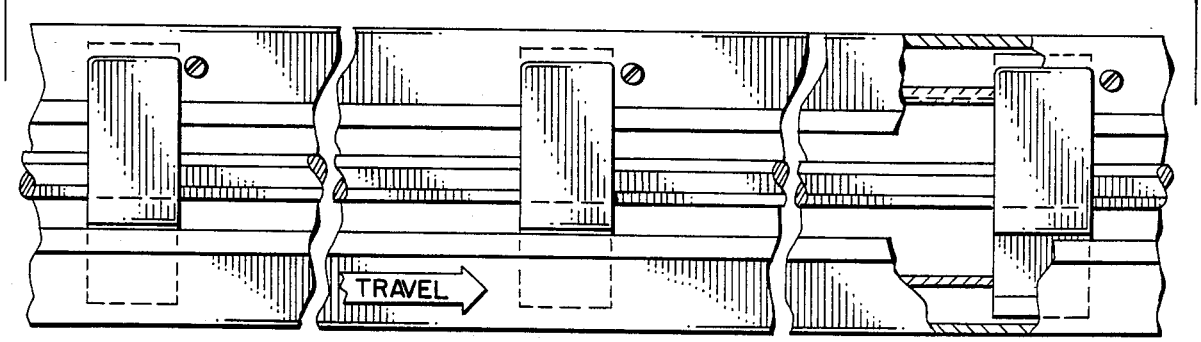

CARRIER ASSEMBLY FOR VERTICAL BLINDS

The present invention relates to a carrier assembly for vertical window coverings and more particularly relates to a carrier assembly having a track for supporting louver or vane carriers which permits the louvers or vanes to be rotated about their vertical axis and further permits them to be drawn traversely across the window opening along the track.

Traversing window covering devices such as vertical blinds, louvers, traversable draperies, vertical shutters and the like are well known. Generally these systems include some type of horizontal track member or element. The track houses multiple carriers from which the vanes, shutters or blinds are vertically suspended. A support rod and/or cord extends through the carriers for extending the carriers between the closed, bunched position and the open position. The cord is generally in a loop arrangement and includes some type of pulley to accomplish opening and closing of the blinds or shutters. Each of the carriers generally includes some type of gear arrangement which, upon actuation, causes the vane or shutter suspended from the carrier to rotate to the desired position. Note the terms "vane", "blind", "louver" and "shutter" are used interchangeably throughout this specification to indicate any type of vertically extending covering for a window or other opening.

A patent representative of the prior art is U.S. Pat. No. 4,293,021 which shows a support member for horizontal members in a traversable opening/covering. The vertical blind includes a plurality of vanes and carriers supporting the vanes in a track structure for traversably supporting the carriers. A rod controls movement of the vanes and in the preferred embodiment, the carriers are traversed by a cord arrangement and the support member also supports the cord. Movement of the cord traverses the carriers and also traverses the support member from one end of the track structure to a predetermined supporting location at the central part of the track structure. The support member is retained at the predetermined location at the central part of the track when the frictional engagement between the cord and the support body is overcome so that further movement of the cord traverses the carriers but not the support members.

Other representative patents showing track systems of the general type include U.S. Pat. Nos. 4,193,438; 4,449,564; 4,350,197; and 3,844,330. While carrier assemblies of the general type have found acceptance in the prior art, the prior art systems as described above have several shortcomings. One problem is that systems of the general type are not adaptable to extremely long track lengths of, for example, fifty feet or more. In such systems several problems occur. One of the problems is that with extended track lengths, it is often necessary to splice the track which results in misalignment of the track sections at the connection which will cause the traversing carriers to hang-up thus rendering the system inoperative. Another problem prevalent with long track runs is that the rod is unsupported when the carriers are retracted and are stacked or bunched at one side of the track structure in the open position. Thus, the actuation rod will sag in the center of the track which will interfere with the mechanical operation of the assembly. A sagging rod may visually detract from the overall appearance of the system and may also cause unwanted noise due to engagement of the rod with the track when the rod is actuated. Further, if excessive sag occurs, engagement of the rod and track may interfere with the operation of the system.

Another problem that is encountered with traversing carrier systems of the general type is that the carriers must be interconnected so that as the blinds are moved to an open position exposing the window, the carriers may assume a bunched or stacked position at one edge of the track. In the opposite position, that is in the closed position, the carriers must space themselves at predetermined locations along the length of the track. The prior art generally utilizes some type of spacers or links attached to the pulley cord which are often inefective and tend to malfunction as they become jammed within the carrier track. Accordingly, there exists a clear need for an improved traversing carrier assembly for horizontal blinds, shutters and the like which is simple, effective and mechanically reliable. The invention will be further understood from the following description and drawings which for convenience are represented in connection with vertical vanes, it being intended that the invention and its application are not limited to vertical vanes but may be generally applied to various traversing arrangements using louvers, vanes, shutters, blinds, drapes and the like.

The present invention is illustrated by way of example and not limited to the figures of the accompanying drawings in which like references indicate similar parts throughout the figures with letters being appended where appropriate for distinguishing like components or elements.

FIG. 10 is a sectional view taken along lines 10—10 of FIG. 3;

FIG. 11 is a sectional view taken along lines 11—11 of FIG. 10;

FIG. 12 is a perspective view of a portion of the track;

FIG. 13 is an end view of a track illustrating a spacer associated therewith;

FIG. 14 is a sectional view taken along lines 14—14 of FIG. 13 illustrating rod support spacers at predetermined positions within the track; and FIG. 15 is a sectional view taken along lines 15—15 of FIG. 14.

Figure 1:
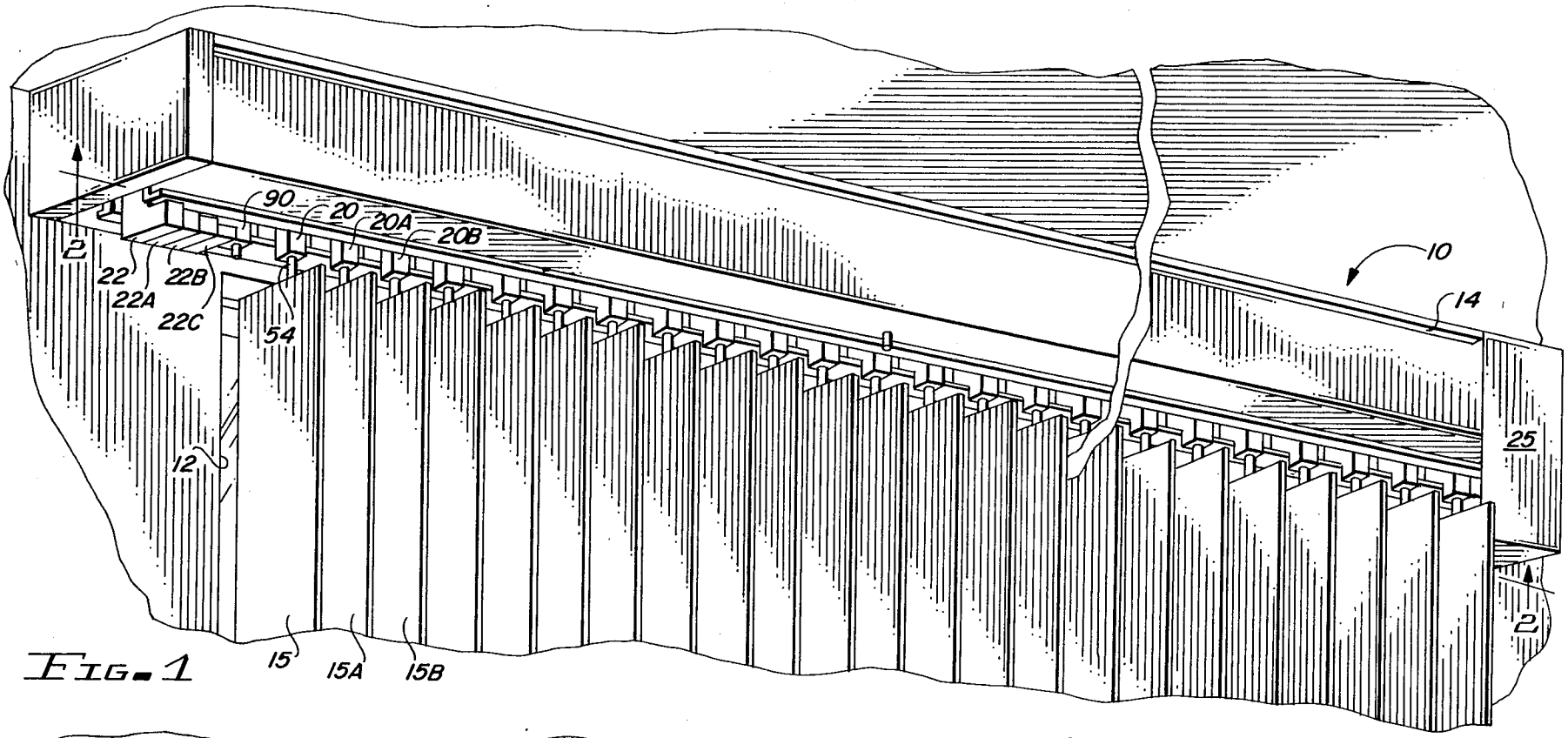
FIG. 1 is a perspective view depicting the carrier assembly in connection with vertical, rotatable vanes or louvers in conjunction with a window opening.
Figure 2:
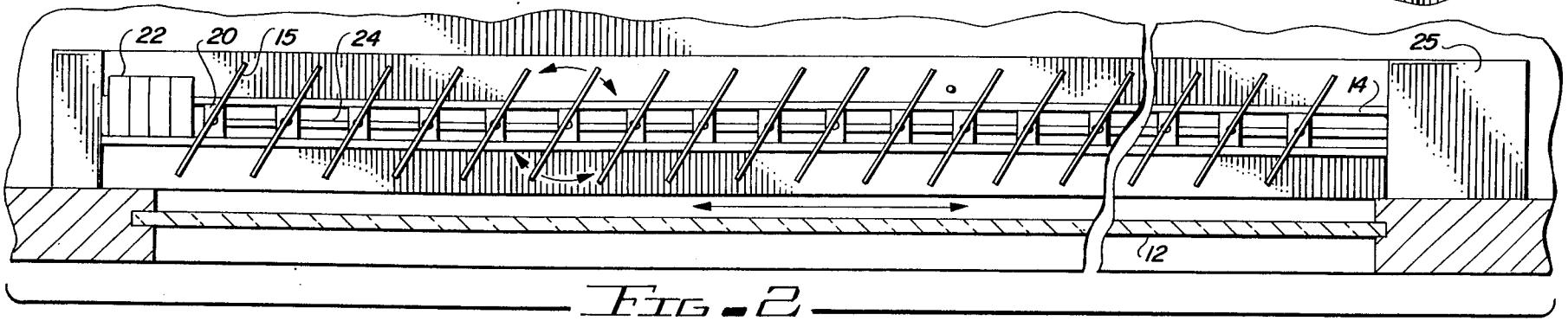
FIG. 2 is a bottom sectional view taken along lines 2—2 of FIG. 1.
Figures 5, 6, 7, 8, 9:
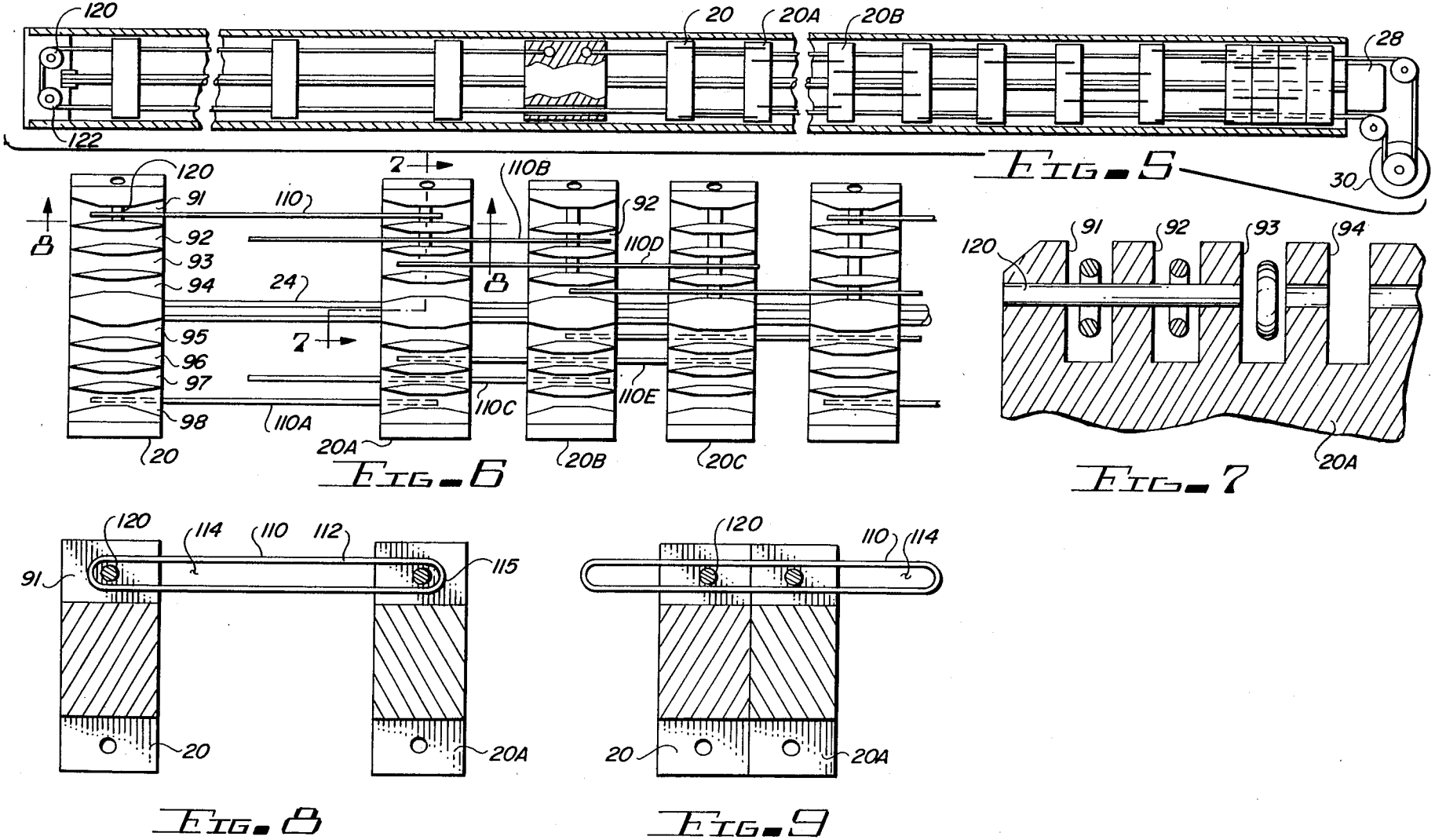
FIG. 5 is a top view of the track and carrier assembly with the cover plate of the track removed illustrating the vanes in a partially open position.
FIG. 6 is an enlarged detail view of several adjacent carriers.
FIG. 7 is a sectional view taken along lines 7—7 of FIG. 6.
FIG. 8 is a sectional view taken along lines 8—8 of FIG. 6.
FIG. 9 is a view similar to FIG. 8 showing adjacent carriers in a bunched or stacked position.

Referring more particularly to the drawings, FIG. 1 depicts the carrier assembly of the present invention which is generally designated by the numeral 10 in connection with window opening 12. The assembly 10 includes track 14A secured in a horizontal position above the window 12. Carrier assembly 10 is shown in a closed position supporting a plurality of vertically extending shutters or vanes 15, 15A, 15B, etc. across the window opening 12. The vanes are supported from individual carriers 20, 20A, 20B, etc. which are slidable within the track 14. Motors 28 and 30, as seen in FIG. 5, are contained within housing 25 at one end of the track. These motors respectively control the rotation of the vanes and the traversing of the carriers 20 within the track. A plurality of spacers 22, 22A, 22B, etc. are shown in a bunched position at the left side of the track as viewed in FIG. 1. As will be more fully explained hereafter, spacers 22 assume spaced-apart supporting positions along the track to support the actuation rod 24 when the vanes 15 are in the open position.

Turning now to FIGS. 10 and 11, the individual carriers 20 from which the vanes 15 are supported and which traverse the track 14 include a body 40 which is shown as being generally rectangular having opposite sides 41, 42, top 43 and bottom 44. The carrier body is constructed from a suitable low friction material such as Nylon, Delrin or the like. Hexagonal actuator rod 24 extends axially through the carrier body and is in driving engagement with gear 46 having bevel gear teeth 46 disposed within the interior 48 of the housing. Gear 46 has an opening which is hexagonal to receive rod 24 and permit carrier 20 to traverse the track 14 along rod 24. Gear 46 is in driving relationship with driven gear 49 through bevel gear teeth 50 which engage the corresponding gear teeth of gear 46. Gear 49 is secured to the upper end of stem 52 which extends vertically through bore 53 in the bottom wall of the spacer body. The lower end of shaft or stem 52 terminates at a hook 54 which supports one of the vanes or shutters 15.

It will be seen that as rod 24 is rotated in one direction or the other, gear 46 and associated gear 49 will rotate vertical stem 52 imparting rotation to each of the associated vanes in unison. Rod 24 is actuated by means of reversible electric motor 28 at the right end of the track. Typically motor 28 would be a 4 r.p.m. gear motor.

As shown, track 14 incorporates a predetermined number of carriers corresponding to the number of shutters or vanes desired. Each of the carriers is provided with a pair of opposed horizontally extending apertures 60 and 61 at intermediate locations at either side of the carrier body. The apertures 60 and 61 permit the pulley cord 70 to freely pass through the carriers. The opposite vertical sides 41 and 42 of the carrier are provided with slots 62 and 64 which receive inwardly projecting longitudinally extending guide ribs 82 and 83 at opposite sides of the track 14. The carrier body has a bushing 65 projecting downwardly which is received in longitudinally extending slot 85 in the bottom wall 86 of the track 14. The engagement of the slots 62, 64 with the ribs 82, 83 and the engagement of bushing 65 within longitudinal opening 85 serves to stabilize and guide traversing of the carrier within the track. As mentioned above, any predetermined number of carriers 20 may be provided consistent with the length of the track and the geometry and dimensions of the individual vanes or shutters 15.

The upper horizontal side 43 of each of the carriers 20 is provided with a series of vertically depending slots 91 through 98. Slots 91 through 94 are positioned on the left of center of the carrier as shown in FIG. 10 and slots 95 through 98 are positioned on the right side. The spacing from the vertical centerline of the carrier to slot 94 is the same as the distance from the centerline to slot 95. The remaining slots are similarly arranged in symmetrical fashion. A second series of vertically extending slots 101 through 108 are provided in the bottom horizontal surface 44 of the carriers and are symmetrically arranged similarly to slots 91 through 98. The slots in the upper and lower surfaces of the carrier accomodate interconnecting links 110 as will be explained hereafter. A transverse bore 111 intercepts the slots to accomodate attachment of the links.

As best seen in FIGS. 6 to 9, adjacent carriers are interconnected by elongate links 110 having opposite horizontally extending sides 112 joined at curved ends 115 so that an elongate interior loop 114 is formed. Carrier 20 is connected to carrier 20A by link 110 extending between slots 91 in each of the carriers. Pin 120 extends transversely in bore 111 through the loop 110 to secure the link 110 within the slots at the adjacent carriers. The pin 120 is freely moveable within the loop 114 defined between opposite sides 112 and 114 of the link. The opposite sides of adjacent carriers 20 and 20A are joined by link 110A extending between lower opposed slots 108 in the respective carriers.

The next adjacent carriers 20A and 20B are interconnected by links 110B extending between slots 92 in the upper surfaces of the carriers and link 110C extending between slots 107 in the lower sides of the adjacent carriers. The next adjacent pair of carriers 20B and 20C are similarly interconnected by links 110D extending between slots 93 and link 110E extending between lower slots 106 in the adjacent carriers. This pattern of connection continues with adjacent carriers being interconnected by an opposed pair of links which are on opposite sides of the vertical centerline through the carrier and each of which are equally spaced from the centerline and are on opposite surfaces of the carriers so that when the spacers are moved to a closed position (moving leftward as seen in FIG. 6), any application of torque or twisting of the adjacent block being pulled is minimized. When the blocks are bunched or in the open position as shown in FIG. 9, the adjacent aligned slots in the carriers provide clearance to receive the links.

Figures 3, 4:
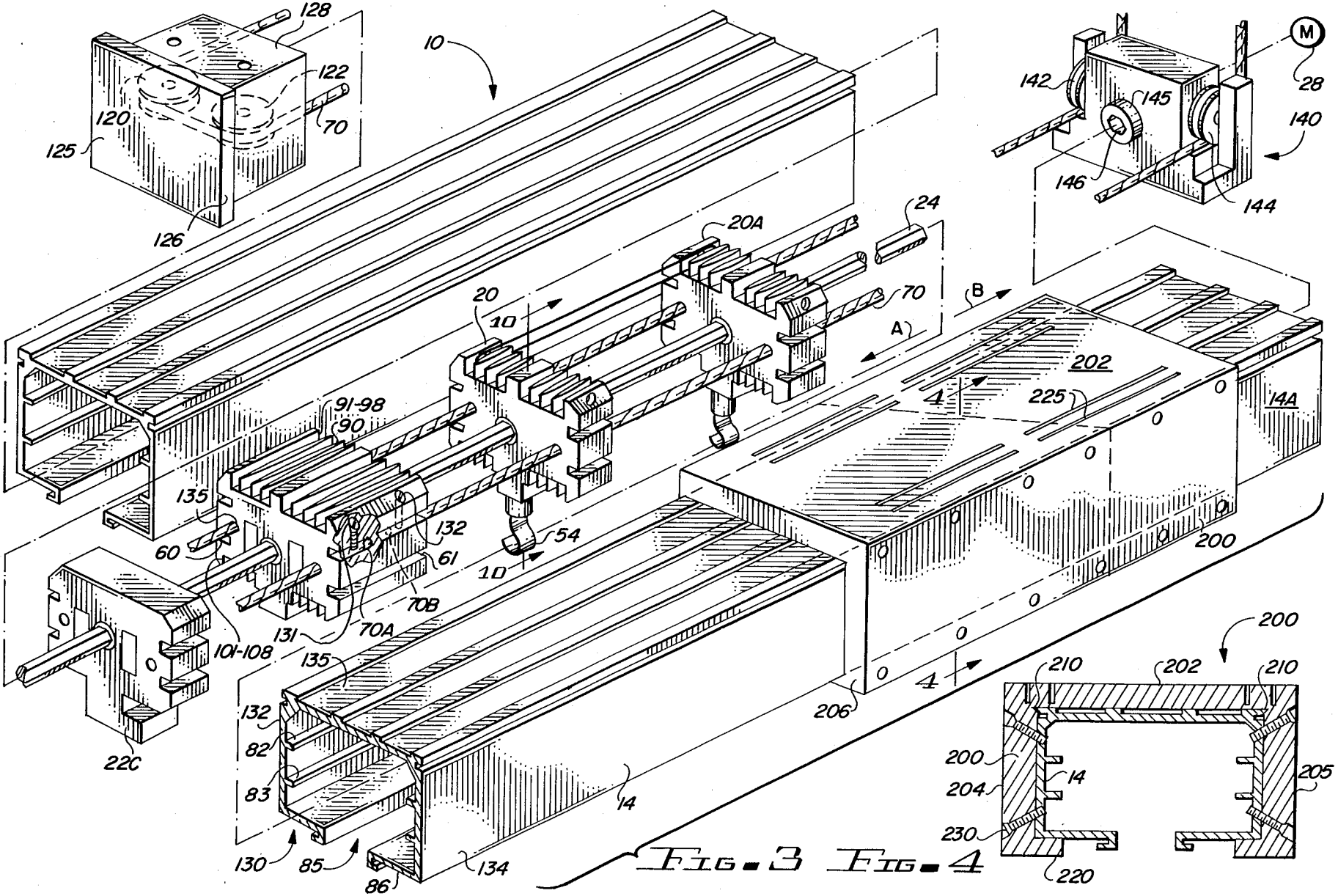
FIG. 3 is an exploded perspective view of the carrier assembly.
FIG. 4 is a sectional view taken along lines 4—4 of FIG. 3.

The blocks are advanced or retracted by means of pulley 70 which consists of a continuous loop of cord driven by reversible motor 30. The loop 70 extends or returns about horizontally disposed pulleys 120 and 122 in end cap 125 at the left end of the track 114, as best seen in FIGS. 3 and 5. End cap 125 includes a cover plate 126 and generally rectangular housing member 128 which is receivable within the opening in track 14. Track 14 has a generally rectangular interior 130 defined by opposite side walls 132 and 134 and upper surface 135. Lower surface or bottom 86 defines longitudinal opening 85 so as to slidably accomodate carriers 20. The track is preferably extruded from a suitable material such as aluminum and may be provided in any convenient length.

A pulley block 140 is also provided at the right hand end of the track and includes oppositely positioned pulleys 142 and 144 which rotate about a horizontal axis. Bushing 145 defining a hexagonal opening 146 is provided in the body of block 140 to rotatably receive actuator rod 24. Pulley loop 70 may be actuated in either direction under the control of motor 30.

Referring to FIG. 3, the pulley loop 70 is continuous having one end 70A secured by set screw 131 at lead or master carrier block 90. The opposite end of the pulley loop 70B is similarly fixed at lead or master carrier 90 by set screw 132. Carrier loop 70 freely passes through lead or master carrier 90 at aperture 135 in the opposite side of the carrier body. The lead carrier 90 is constructed of a low friction material and is configured to freely slide or reciprocate within track 14. Lead carrier is provided with opposite slots 60 and 61 which receive projecting ribs 82, 83 at the track interior to guide the traverse of the block. The block is further provided with vertically extending slots 91 through 98 on the upper surface and slots or grooves 101 through 108 at the lower surface for reception of connecting links 110 as has been described. Carrier body defines an aperture through which rod 24 may pass. The carrier block may, if desired, be provided with a bevel drive and a driven gear for receiving a vane hanger. Generally, it is preferred that the carrier block not include these additional mechanical components. In other respects the master carrier 90 is constructed as has been described with reference to carrier blocks 20.

From the foregoing, it will be seen that in the event the pulley loop 70 is actuated in the direction of arrow A as seen in FIG. 3, master or lead carrier 90 will be pulled leftward since end 70A is secured to the lead carrier at set screw 131. The leftward movement of the lead carrier will cause the next adjacent following carrier 20 to move leftward when carrier 90 has moved away from carrier 20 a distance corresponding to the length of the loops 114 of the connecting links 110. Thereafter, as carrier 90 and 20 move leftward, carrier 20A will be also caused to move leftward when carrier 20 moves away a distance corresponding to the length of the links 110 interconnecting carriers 20 and 20A. This sequence is repeated until the lead or master carrier 90 is stopped at any predetermined position along the track. Note that the spacing between all adjacent carriers is precisely maintained and is established by the length of the interconnecting carriers. Thus, the supported shutters or vanes will be traversed from the closed or bunched position to the open or partially open position with equal distance spacing being maintained therebetween.

In the event it is desired to open the blinds, that is move the carriers to a bunched position at the right hand side of the track, the motor 30 is actuated to cause the pulley loop to move in a direction indicated by the arrow B in FIG. 3. When this occurs, the lead carrier will move first rightward until it engages the next adjacent carrier 20 causing it to move. This sequence is repeated as carrier 20 will move rightward engaging 20A and so on until all of the carriers are moved rightward to the desired bunched position. The interconnecting links 110 allow the carriers to traverse in the closing direction until they abut and the associated links will be received or accomodated in the adjacent aligned slots so no interference occurs. Note that rod 24 remains in a fixed position and that the carriers move along the rod 24 so that the individual vanes may be rotated at any position of the vanes along the traverse track.

One particular problem arising from the fact that the rod remains in the fixed position within the center of the track is that if the rod is unsupported it may sag and cause mechanical interference or unwanted noise. Accordingly, a plurality of rod support spacers 22, 22A, 22B, etc. are provided at the left side of the lead carrier 90 as seen in FIG. 1. In the closed position, the support carriers 22 assume a bunched position as shown in FIG. 1. In the open position, the bunched carriers are spaced at equal intervals along the track 14 to support the rod 24. The construction of the individual rod support carrier 22 and their operation is best seen in FIGS. 12 through 15. Individual rod support carriers 22 have a body 150 of nylon or other low friction material and generally configured to be slidably received within track 14. The body 150 has horizontal slots 152 and 153 at either vertical edge to receive ribs 82 and 83 for smooth, guided traverse within the track. A vertical projection 155 extends through opening 85 in the track. A horizontally extending trip arm 158 extends from projection 155 and defines a predetermined space 160 between the upper edge of the trip arm 158 and the lower edge of the track. Pins 162 extend vertically at spaced apart locations along the underside of the track 14. Pins 162 are shown as screws in threaded engagement in the track. Note that the position of pin 162 is such that if the overall length of the pin is greater than spacing 160, pin 162 will engage the trip arm 158. One vertical face of the rod support spacer is provided with a magnetic insert 172. The opposite vertical face is provided with an insert 175 of ferrous material so that a magnetic attraction exists between adjacent spacers. Further, as best seen in FIG. 3, one face of the lead carrier 90 adjacent the spacer blocks 22 is provided with an insert 180 so that a magnetic attraction exists between the next adjacent spacer 226 and the lead carrier. The construction of the spacers will be better understood from the following description of their function and operation.

When the vanes are in a fully closed position, the individual vane carriers 20 support the rod at predetermined spaced apart locations. However, in the event the blinds are drawn or partially drawn to an open position, at least a portion of the length of the actuator rod 24 would be unsupported were it not for the inclusion of the support spacers 22. Accordingly, the spacers are spaced at intervals along the track as the master carrier 90 is traversed in vane opening direction. As the master carrier 90 moves rightward as viewed in FIGS. 3, 15 and 16, the blinds will open. The rightward movement of the lead carrier 90 will, through the magnetic attraction that exists between the magnet 175 in spacer 22B and insert 180 in the lead carrier 90, causing the spacer 22C to also move rightward. Since all of the spacer carriers are magnetically attracted to the next adjacent carrier, the entire group of the spacer carriers will move rightward a predetermined distance with the lead carrier. When the left-most carrier, designated as 22 in FIG. 1, reaches the location of the first pin 160, it will drop off from the group of carriers by virtue of the engagement of stop arm 158 with the pin 162. When the next adjacent carrier 22A reaches the next pin 162A, it will also stop. As best seen in FIG. 15, the space 160 that exists between the underside of the track and the upper surface 158 of the stop arm of carrier 22A is less than this spacing for the next adjacent carrier 22B. Similarly, the next adjacent carrier 22B has a greater spacing 160 than does 22B and 22C. Thus, carriers 22A and 22B will clear pin 162. Carrier 22A will be tripped or caused to engage pin 162A at the next location and so on. Thus, if the vanes are fully open, carriers 22 through 22C will be evenly distributed along the length of the track at predetermined locations corresponding to the locations of pins 162, 162A, 162B and 162C. Conversely, when the vanes are closed over the window, carrier 90 will move leftward engaging the carriers as it moves until the carriers are all grouped at the left side of the track as shown in FIG. 1. At any intermediate location, the rod support spacers to the left of the carrier will remain in a rod-supporting position along the track.

With the carrier assembly of the present invention, the track can be provided in any desired length. With prior art arrangements, track lengths were usually limited to a maximum of approximately twenty feet in length. However, with the present invention track lengths in excess of fifty feet are achievable. Obviously, the number of carriers and support spacers will be determined by the length of the track and the geometry and dimension of the vanes or shutters suspended from the carriers. Typically however for a track of fifty foot length with vanes or shutters having a width of 3½", approximately 198 carriers would be used and four number of spacers would be appropriate or required for supporting the rod in the open position.

In some instances it has been found necessary to splice the track to achieve the required track length. With prior art arrangements, splicing of the track was not generally practical as the splice would introduce slight misalignment of the track which would cause the carriers to hang-up as they traverse the track. However, with the present invention, the track may be spliced using the connector shown in FIGS. 3 to 4. Adjacent track sections 14 and 14A abut. It is preferable that the ends of the abutting track sections 14 and 14A are each cut at a cooperating angle of approximately 30°. Connector 200 is then placed over the abutting end sections. Connector 200 is box-like having an upper surface 202 and opposite side walls 204 and 206 which closely or tightly engage the opposite sides and top of the adjacent track sections. The connector is preferably of an extruded aluminum and has relatively thick side and top sections as compared to the side walls of the track which will reinforce the track at the joint. It is noted that the track 14 may be extruded with slightly projecting upper corners 210 which is received in longitudinal notch 215 at inner corners of the connector.

The lower ends of side sections 204 and 206 of the connector are provided with inwardly extending flanges 220 which engage the undersurface of the lower corners of the track. One or more longitudinally extending slots 225 are provided in the upper surface of the connector at a location approximately above the extension of the side wall of the track. Slots 225 extend through the upper surface 202 of the connector. The connector is secured to the track by a plurality of self-tapping metal screws 230 which angularly extend into the area adjacent the opposite upper corners of the track and the opposite lower corners of the track. As the screws are turned to predetermined tightness, the adjacent track sections may be precisely aligned. The inclusion of slots 225 allow for a certain amount of adjustment to accomodate track alignment.

The present invention has been illustrated and described with vertical blinds or shutter arrangements having electric motor for actuating rotating of the blinds and for traversing the blinds. It is within the scope of the present invention to utilize the invention with manual actuation means as well. Also, as pointed out above, the carrier assembly of the present invention can be used with different types of vertical blinds and shutters and can accomodate tracks of varying lengths and configurations. It is also within the invention to arrange the carrier system so as to open in either direction of travel or open in opposite directions of travel from an intermediate location along the track. In these variations, the system will be as described above and any necessary modifications will be apparent to those skilled in the art.

It will be apparent to those skilled in the art to make certain changes and modifications to the embodiments disclosed herein. It is the applicant's intention to cover all those changes and modifications which could be made to the embodiments of the invention shown herein for the purposes of disclosure without departing from the spirit and scope of the appended claims.

I claim:

1. A window opening covering system of the type having a plurality of adjustable vanes, traversible between an open and closed position, said system comprising:

(a) a longitudinally extending track adapted to extend at least part way across the opening;

(b) a rod extending along said track and being adapted for rotation;

(c) means for rotating said rod;

(d) a plurality of vane carriers for supporting the vanes and moveable in a first direction to close said vanes and in a second direction to open said vanes, said vane carriers having actuation means cooperable with said rod whereby upon rotation of the rod the said vanes are rotated;

(e) a lead carrier having opposite first and second sides, said lead carrier being positioned at one end of said plurality of vane carriers with said first side adjacent said carriers;

(f) a pulley system operatively connected to said lead carrier to cause said lead carrier to move in said first and second directions upon actuation;

(g) link means connecting said lead carrier to said next adjacent vane carrier and connecting adjacent vane carriers to one another at symmetrical locations on said carriers, said links allowing predetermined carrier movement in said second direction before exerting a pull on the next adjacent carrier in said second direction of travel and upon actuation of said lead carrier in said first direction of travel allowing said carriers to engage one another as the lead carrier traverses the track in said first direction; and (h) a plurality of spacers located at said second side of said lead carrier along said track, said spacers and lead carrier including magnetic means adapted to exert a magnetic attraction between adjacent spacers and said lead carrier and trip means associated with said track whereby spacers are deposited at predetermined locations along said track when said lead carrier is moved in said second direction thereby providing support for said rod.

2. The system of claim 1 wherein said carriers define longitudinally extending slots and wherein said links define a generally elongate extending slot with fastener means extending transversely of said link slots at the slots in said adjacent carriers.

3. The system of claim 2 wherein opposite sides of said carriers define longitudinally extending grooves and wherein said track defines projections cooperable with said grooves to guide said carriers along said track.

4. The system of claim 3 further including a reversible motor associated with said pulley system and wherein said pulley includes a flexible cord loop having its opposite ends secured at said lead carrier.

5. The system of claim 4 wherein said track comprises at least two separate abutting sections having a top, sides and a bottom defining a longitudinal opening, said track section interconnected at an exterior connector, said connector having a general box structure having a top and opposite sides closely fitting about the top and sides of the abutting track sections, at least one of said connector top or side members defining a longitudinal slot and fastener means extending between said connector and said track sections to secure and align said track sections within said connector.

6. A window opening covering system of the type having a plurality of adjustable vanes, traversible between an open and closed position, said system comprising:

(a) a longitudinally extending track adapted to extend at least part way across the opening;

(b) a rod extending along said track and being adapted for rotation;

(c) means for rotating said rod;

(d) a plurality of vane carriers for supporting the vanes and moveable in a first direction to close said vanes and in a second direction to open said vanes, said vane carriers having actuation means cooperable with said rod whereby upon rotation of the rod the said vanes are rotated;

(e) a lead carrier having opposite first and second sides, said lead carrier being positioned at one end of said plurality of vane carriers with said first side adjacent said carriers;

(f) a pulley system operatively connected to said lead carrier to cause said lead carrier to move in said first and second directions upon actuation; and (g) link means connecting said lead carrier to said next adjacent vane carrier and connecting adjacent vane carriers to one another in at least two opposed locations on said carriers whereby a balanced pulling force is exerted on said carriers, said link means allowing predetermined carrier movement in said first direction before exerting a pull on the next adjacent carrier in said first direction of travel and upon actuation of said lead carrier in said second direction of travel allowing said carriers to successively engage one another as the lead carrier traverses the track in said second direction.

* * * * *